US011675285B2

(12) United States Patent
Tomita et al.

(10) Patent No.: US 11,675,285 B2
(45) Date of Patent: Jun. 13, 2023

(54) ELECTROSTATIC IMAGE DEVELOPING TONER, METHOD FOR PRODUCING ELECTROSTATIC IMAGE DEVELOPING TONER, ELECTROSTATIC IMAGE DEVELOPER, TONER CARTRIDGE, PROCESS CARTRIDGE, AND IMAGE FORMING APPARATUS

(71) Applicant: FUJIFILM Business Innovation Corp., Tokyo (JP)

(72) Inventors: Daisuke Tomita, Kanagawa (JP); Keita Yamamoto, Kanagawa (JP); Daisuke Noguchi, Kanagawa (JP); Kazuhiko Nakamura, Kanagawa (JP); Hiroshi Nakazawa, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 0 days.

(21) Appl. No.: 17/408,058

(22) Filed: Aug. 20, 2021

(65) Prior Publication Data

US 2022/0373909 A1 Nov. 24, 2022

(30) Foreign Application Priority Data

May 21, 2021 (JP) ..... JP2021-086311

(51) Int. Cl.

| | |
|---|---|
| ***G03G 9/087*** | (2006.01) |
| ***G03G 9/08*** | (2006.01) |
| ***G03G 9/083*** | (2006.01) |
| ***G03G 9/09*** | (2006.01) |
| ***G03G 15/06*** | (2006.01) |

(52) U.S. Cl.

CPC ..... *G03G 9/08755* (2013.01); *G03G 9/083* (2013.01); *G03G 9/0819* (2013.01); *G03G 9/0902* (2013.01); *G03G 9/0906* (2013.01); *G03G 15/06* (2013.01)

(58) Field of Classification Search

CPC .. G03G 9/08755; G03G 9/0819; G03G 9/083; G03G 9/0902; G03G 9/0906; G03G 15/06

See application file for complete search history.

(56) References Cited

U.S. PATENT DOCUMENTS

| | | | | |
|---|---|---|---|---|
| 9,983,491 | B2 | 5/2018 | Onishi et al. | |
| 10,578,988 | B2 | 3/2020 | Yamauchi et al. | |
| 2005/0175923 | A1* | 8/2005 | Nakazawa | G03G 9/0819 430/108.8 |

(Continued)

FOREIGN PATENT DOCUMENTS

| | | | | |
|---|---|---|---|---|
| JP | 2012118499 A | * | 6/2012 | G03G 9/0804 |
| JP | 2013-76915 A | | 4/2013 | |

(Continued)

*Primary Examiner* — Ryan D Walsh

(74) *Attorney, Agent, or Firm* — Oliff PLC

(57) ABSTRACT

An electrostatic image developing toner includes toner particles containing a binder resin. In a differential scanning calorimetry curve of the toner particles, Tg1 is 58° C. or more and 68° C. or less, and Tg1−Tg2 is 20° C. or more and 40° C. or less, where Tg1 is a lowest onset temperature in an endothermic change during a first temperature increase, and Tg2 is a lowest onset temperature in an endothermic change during a second temperature increase.

20 Claims, 2 Drawing Sheets

(56) References Cited

U.S. PATENT DOCUMENTS

| | | | | |
|---|---|---|---|---|
| 2012/0052434 | A1* | 3/2012 | Sugimoto | G03G 9/08797<br>430/108.8 |
| 2020/0301300 | A1* | 9/2020 | Miura | G03G 9/08795 |

FOREIGN PATENT DOCUMENTS

| | | | | | |
|---|---|---|---|---|---|
| JP | 2016-206632 | A | | 12/2016 | |
| JP | 2017037245 | A | * | 2/2017 | G03G 9/0806 |
| JP | 2017062414 | A | * | 3/2017 | G03G 9/0821 |
| JP | 2017107138 | A | * | 6/2017 | G03G 15/00 |
| JP | 2017-156505 | A | | 9/2017 | |
| KR | 20150076110 | A | * | 7/2015 | |

* cited by examiner

ELECTROSTATIC IMAGE DEVELOPING TONER, METHOD FOR PRODUCING ELECTROSTATIC IMAGE DEVELOPING TONER, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2021-086311 filed May 21, 2021.

BACKGROUND

(i) Technical Field

The present disclosure relates to an electrostatic image developing toner, a method for producing an electrostatic image developing toner, an electrostatic image developer, a toner cartridge, a process cartridge, and an image forming apparatus.

(ii) Related Art

Japanese Unexamined Patent Application Publication No. 2017-156505 discloses a method for producing a toner. The method includes a first step of heating a dispersion containing an aqueous medium and toner base particles formed by aggregating and fusing fine particles of a binder resin including a crystalline resin in the presence of metal ions to a temperature higher than or equal to the melting point of the crystalline resin, and a second step of maintaining a temperature T (° C.) of the dispersion that satisfies the relation $Rc-25 \leq T \leq Rc-5$ (where Rc is a recrystallization temperature of the crystalline resin) for 30 minutes or more with the pH of the dispersion maintained at 5.5 or more and 9.0 or less.

Japanese Unexamined Patent Application Publication No. 2016-206632 discloses a toner whose diffraction peak in an X-ray diffraction measurement is present at least at 20=20° to 25° and whose difference between first and second glass transition temperatures observed using a differential scanning calorimeter (DSC) is 10° C. or less, the first glass transition temperature being observed in the final heating step of heating and cooling performed under the following temperature increase and decrease conditions: the temperature is increased from a starting temperature of 20° C. to 120° C. at 10° C./min, held at 120° C. for 10 minutes, decreased to 0° C. at 10° C./min, and increased to 150° C. at 10° C./min with no holding time at 0° C., the second glass transition temperature being observed in the final heating step of heating and cooling performed under the following temperature increase and decrease conditions: the temperature is increased from a starting temperature of 20° C. to 120° C. at 10° C./min, held at 120° C. for 10 minutes, decreased to 0° C. at 10° C./min, increased to 45° C. at 10° C./min with no holding time at 0° C., held there for 24 hours, decreased to 0° C. again at 10° C./min, and increased to 150° C. at 10° C./min with no holding time at 0° C.

Japanese Unexamined Patent Application Publication No. 2013-076915 discloses an electrostatic image developing toner including at least amorphous polyester and crystalline polyester. The toner has a glass transition point $Tg_{1st}$, which is measured with a differential scanning calorimeter when a toner sample is heated from 30° C. to 170° C. at a rate of 10° C./min, of 60° C. to 70° C. $Tg_{1st}$ and a glass transition point $Tg_{2nd}$ of the toner, which is measured with a differential scanning calorimeter when the toner sample is cooled to 30° C. at a rate of 100° C./min after the measurement of $Tg_{1st}$ and then heated at a rate of 10° C./min from 30° C. to 170° C., satisfy the relation expressed by formula "$10° C. \leq Tg_{1st} - Tg_{2nd} \leq 15° C.$". In tetrahydrofuran soluble of the toner, the content of molecules having a molecular weight of 50,000 or more is 20 to 35 mass %, and the content of molecules having a molecular weight of 10,000 or less is 40 to 55 mass %.

SUMMARY

From the viewpoint of, for example, high-speed operation and low energy consumption of image forming apparatuses, there is a need for toners having high low-temperature fixability. The low-temperature fixability of a toner can be provided, for example, by controlling the glass transition temperature of the toner in a specific range. However, such a toner having a controlled glass transition temperature may provide a fixed image with low color forming properties while having low-temperature fixability.

Aspects of non-limiting embodiments of the present disclosure relate to an electrostatic image developing toner that includes toner particles whose Tg1 is 58° C. or more and 68° C. or less and that provides a fixed image having high color forming properties as compared to when Tg1−Tg2 is less than 20° C.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developing toner including toner particles containing a binder resin. In a differential scanning calorimetry curve of the toner particles, Tg1 is 58° C. or more and 68° C. or less, and Tg1−Tg2 is 20° C. or more and 40° C. or less, where Tg1 is a lowest onset temperature in an endothermic change during a first temperature increase, and Tg2 is a lowest onset temperature in an endothermic change during a second temperature increase.

BRIEF DESCRIPTION OF THE DRAWINGS

Exemplary embodiments of the present disclosure will be described in detail based on the following figures, wherein.

DETAILED DESCRIPTION

Figure 1:
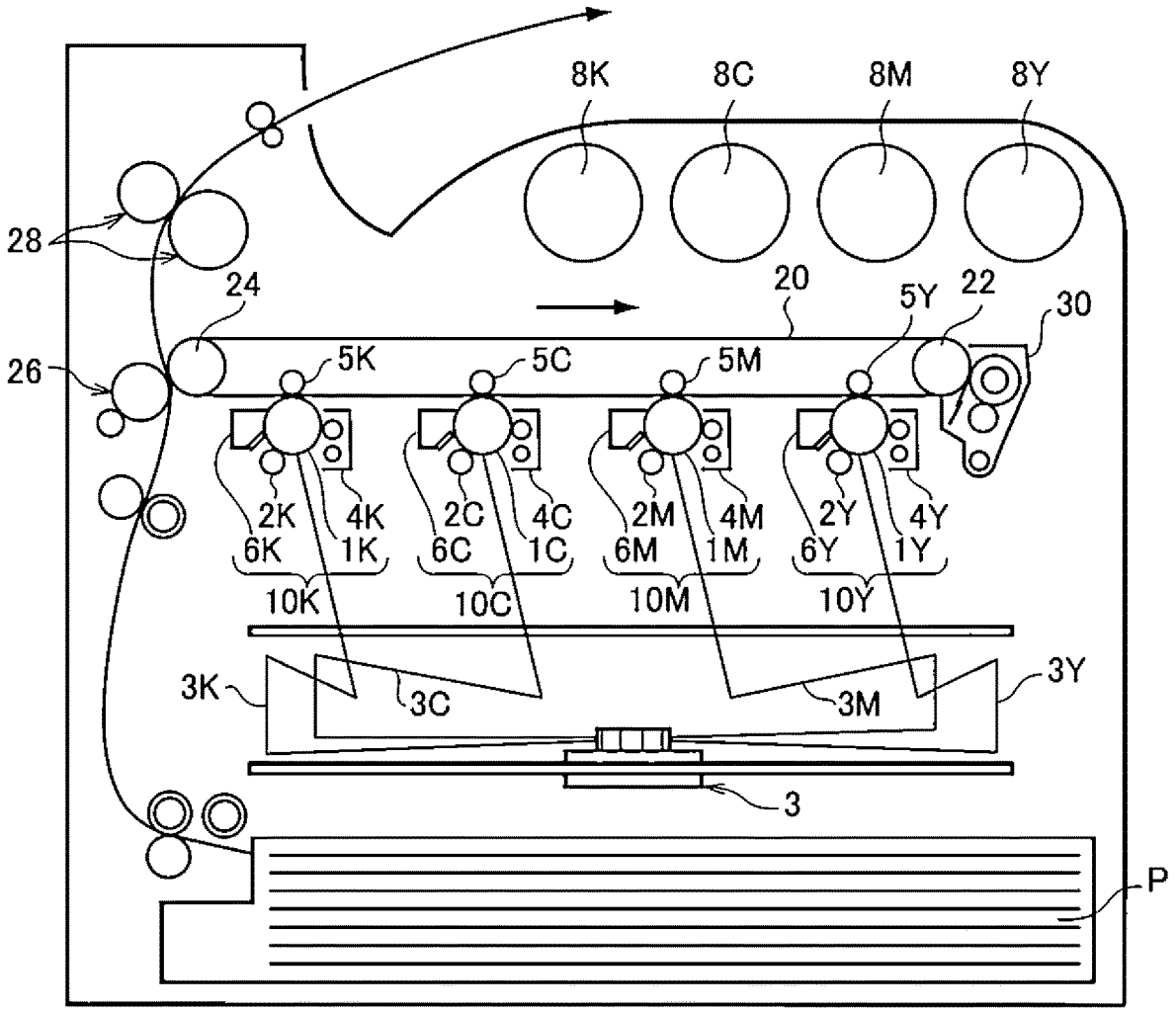
FIG. 1 illustrates a schematic configuration of an image forming apparatus according to an exemplary embodiment.

Exemplary embodiments of the present disclosure will be described below. The following description and Examples are illustrative of the exemplary embodiments and are not intended to limit the scope of the disclosure.

In numerical ranges described in stages in this specification, the upper limit value or the lower limit value described in one numerical range may be replaced with the upper limit value or the lower limit value of other numerical ranges described in stages. In a numerical range described in this specification, the upper limit value or the lower limit value of the numerical range may be replaced with a value described in Examples.

Components may each include plural corresponding substances.

If there are two or more substances corresponding to one component in a composition, the amount of the component in the composition refers to the total amount of the two or more substances present in the composition, unless otherwise specified.

Electrostatic Image Developing Toner

An electrostatic image developing toner (hereinafter, the electrostatic image developing toner is also referred to as the "toner") according to an exemplary embodiment includes toner particles containing a binder resin. In a differential scanning calorimetry curve of the toner particles, Tg1 is 58° C. or more and 68° C. or less, and Tg1−Tg2 is 20° C. or more and 40° C. or less, where Tg1 is a lowest onset temperature in an endothermic change during a first temperature increase, and Tg2 is a lowest onset temperature in an endothermic change during a second temperature increase.

Here, the differential scanning calorimetry curve of the toner particles is obtained by a measurement in accordance with ASTM D3418-8.

Specifically, 10 mg of toner particles (or toner particles with an external additive added) to be measured is set to a differential scanning calorimeter (DSC-60A manufactured by Shimadzu Corporation) equipped with an automatic tangent analysis system, and heated from 10° C. to 150° C. at a temperature increase rate of 10° C./min to obtain a temperature increase spectrum (DSC curve) of the first temperature-increasing process. Subsequently, the temperature is held at 150° C. for 5 minutes and decreased to 0° C. at a temperature decrease rate of 10° C./min.

Next, the toner particles are heated again from 10° C. to 150° C. at a temperature increase rate of 10° C./min to obtain a temperature increase spectrum (DSC curve) of the second temperature-increasing process. Subsequently, the temperature is held at 150° C. for 5 minutes and decreased to 25° C. at a temperature decrease rate of 10° C./min.

The lowest onset temperature in the endothermic change in the temperature increase spectrum (DSC curve) of the first temperature-increasing process obtained by the above measurement is referred to as Tg1, and the lowest onset temperature in the endothermic change in the temperature increase spectrum (DSC curve) of the second temperature-increasing process is referred to as Tg2.

With the above configuration, the toner according to the exemplary embodiment may provide a fixed image having high color forming properties. The reason for this is presumably as follows.

From the viewpoint of, for example, high-speed operation and low energy consumption of image forming apparatuses, there is a need for toners having high low-temperature fixability. The low-temperature fixability of a toner can be provided, for example, by controlling the glass transition temperature of the toner in a specific range. Specifically, the low-temperature fixability of a toner may be provided by controlling Tg1 to be 58° C. or more and 68° C. or less.

However, the use of a toner whose Tg1 is in the above range, although providing low-temperature fixability, may provide a fixed image with low color forming properties. The low color forming properties are presumably due to the following reason: upon heating for fixing, a resin undergoes segment orientation and crystallize, as a result of which the transparency of the resin is reduced to provide a fixed image with a dull color.

In contrast, in the exemplary embodiment, Tg1 is 58° C. or more and 68° C. or less, and Tg1−Tg2 is 20° C. or more and 40° C. or less. Presumably due to this, the segment orientation of the resin upon heating may be less likely to occur, and the reduction in transparency due to crystallization of the resin may be suppressed, thus providing a fixed image having high color forming properties, as compared to when Tg1−Tg2 is less than 20° C.

Presumably for these reasons, the toner according to the exemplary embodiment may provide a fixed image having high color forming properties while having low-temperature fixability.

In addition, in the exemplary embodiment, since Tg1−Tg2 is 20° C. or more and 40° C. or less, the heat resistance of a fixed image is higher than when Tg1−Tg2 is more than 40° C. Thus, image defects due to an image transfer that may occur when a plurality of recording media each having a fixed image formed thereon are stacked on top of each other (hereinafter also referred to as "print blocking") may be suppressed.

In addition, in the exemplary embodiment, since Tg1 is 58° C. or more and 68° C. or less, as compared to when Tg1 is less than 58° C., the resistance to mechanical stress and thermal stress in a developing unit may improve to reduce the likelihood of aggregation of the toner, thus suppressing a point-like void in an image that might otherwise arise from aggregation of the toner.

In addition, in the exemplary embodiment, since Tg1 is 58° C. or more and 68° C. or less, low-temperature fixability may be readily provided as compared to when Tg1 is higher than 68° C.

Tg1 and Tg1−Tg2 can be controlled to be in the above ranges, for example, by performing the first cooling step, the holding step, and the second cooling step described below in the process for producing the toner particles.

The toner according to the exemplary embodiment will now be described in detail.

Toner Particles

The toner particles include, for example, a binder resin and, optionally, a colorant, a release agent, and other additives.

Binder Resin

Examples of the binder resin include vinyl resins made of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene); and vinyl resins made of copolymers of two or more of these monomers.

Other examples of the binder resin include non-vinyl resins such as epoxy resins, polyester resins, polyurethane resins, polyamide resins, cellulose resins, polyether resins, and modified rosins; mixtures of these non-vinyl resins and the above vinyl resins; and graft polymers obtained by polymerization of vinyl monomers in the presence of these non-vinyl resins.

These binder resins may be used alone or in combination of two or more.

The binder resin may be a polyester resin.

Examples of the polyester resin include known amorphous polyester resins. The polyester resin may be a combination of an amorphous polyester resin with a crystalline polyester resin. The crystalline polyester resin may be used in an amount of 5 mass % or more and 25 mass % or less (preferably 5 mass % or more and 20 mass % or less) relative to the total amount of binder resin.

When the content of the crystalline polyester resin relative to the total amount of binder resin is in the above range, as compared to when being higher than the above range, the crystallinity of the whole binder resin is low, and thus the transparency of the binder resin may improve to provide a fixed image having high color forming properties. In addition, when the content of the crystalline polyester resin relative to the total amount of binder resin is in the above range, as compared to when being lower than the above range, low-temperature fixability may be provided.

"Crystalline" in the context of a resin means that the resin shows a distinct endothermic peak, rather than a stepwise endothermic change, in differential scanning calorimetry (DSC). Specifically, it means that the half-width of the endothermic peak measured at a temperature increase rate of 10° C./min is within 10° C.

"Amorphous" in the context of a resin means that the half-width exceeds 10° C., that a stepwise endothermic change is shown, or that no distinct endothermic peak is observed.

Amorphous Polyester Resin

Examples of the amorphous polyester resin include polycondensates of polycarboxylic acids with polyhydric alcohols. The amorphous polyester resin for use may be a commercially available product or may be synthesized.

Examples of the polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, and lower (e.g., C1 to C5) alkyl esters thereof. Of these, aromatic dicarboxylic acids are preferred, for example.

The polycarboxylic acid may be a combination of a dicarboxylic acid with a trivalent or higher valent carboxylic acid having a crosslinked or branched structure. Examples of the trivalent or higher valent carboxylic acid include trimellitic acid, pyromellitic acid, anhydrides thereof, and lower (e.g., C1 to C5) alkyl esters thereof.

These polycarboxylic acids may be used alone or in combination of two or more.

Examples of the polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols are preferred, for example, and aromatic diols are more preferred.

The polyhydric alcohol may be a combination of a diol with a trivalent or higher valent polyhydric alcohol having a crosslinked or branched structure. Examples of the trivalent or higher valent polyhydric alcohol include glycerol, trimethylolpropane, and pentaerythritol.

These polyhydric alcohols may be used alone or in combination of two or more.

The glass transition temperature (Tg) of the amorphous polyester resin is preferably 50° C. or more and 80° C. or less, more preferably 50° C. or more and 65° C. or less.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K 7121-1987 "Testing Methods for Transition Temperatures of Plastics".

The weight-average molecular weight (Mw) of the amorphous polyester resin is preferably 5,000 or more and 1,000,000 or less, more preferably 7,000 or more and 500,000 or less.

The number-average molecular weight (Mn) of the amorphous polyester resin is preferably 2,000 or more and 100,000 or less.

The molecular weight distribution Mw/Mn of the amorphous polyester resin is preferably 1.5 or more and 100 or less, more preferably 2 or more and 60 or less.

The weight-average molecular weight and the number-average molecular weight are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a THF solvent. The weight-average molecular weight and the number-average molecular weight are determined using a molecular weight calibration curve prepared from the measurement results relative to monodisperse polystyrene standards.

The amorphous polyester resin is produced by a known method. Specifically, the amorphous resin is produced, for example, by performing a polymerization reaction at a temperature of 180° C. to 230° C., optionally while removing water and alcohol produced during condensation by reducing the pressure in the reaction system.

If any starting monomer is insoluble or incompatible at the reaction temperature, it may be dissolved by adding a high-boiling solvent as a solubilizer. In this case, the polycondensation reaction is performed while distilling off the solubilizer. When a poorly compatible monomer is present, the poorly compatible monomer may be condensed with an acid or alcohol to be polycondensed with the monomer before being polycondensed with the major components.

Crystalline Polyester Resin

Examples of the crystalline polyester resin include polycondensates of polycarboxylic acids with polyhydric alcohols. The crystalline polyester resin for use may be a commercially available product or may be synthesized.

To easily form a crystalline structure, the crystalline polyester resin may be a polycondensate prepared from linear aliphatic polymerizable monomers rather than from aromatic polymerizable monomers.

Examples of the polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), anhydrides thereof, and lower (e.g., C1 to C5) alkyl esters thereof.

The polycarboxylic acid may be a combination of a dicarboxylic acid with a trivalent or higher valent carboxylic acid having a cross-linked or branched structure. Examples of the tricarboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., C1 to C5) alkyl esters thereof.

The polycarboxylic acid may be a combination of such a dicarboxylic acid with a dicarboxylic acid having a sulfonic group or a dicarboxylic acid having an ethylenic double bond.

These polycarboxylic acids may be used alone or in combination of two or more.

Examples of the polyhydric alcohols include aliphatic diols (e.g., linear aliphatic diols having 7 to 20 main-chain carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

The polyhydric alcohol may be a combination of a diol with a trivalent or higher valent alcohol having a cross-linked or branched structure. Examples of the trivalent or higher valent alcohol include glycerol, trimethylolethane, trimethylolpropane, and pentaerythritol.

These polyhydric alcohols may be used alone or in combination of two or more.

The amount of aliphatic diol in the polyhydric alcohol may be 80 mol % or more and is preferably 90 mol % or more.

The melting temperature of the crystalline polyester resin is preferably 50° C. or more and 100° C. or less, more preferably 55° C. or more and 90° C. or less, still more preferably 60° C. or more and 85° C. or less.

The melting temperature is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

The weight-average molecular weight (Mw) of the crystalline polyester resin is preferably 6,000 or more and 35,000 or less.

The crystalline polyester resin is produced, for example, by a known method, as with the amorphous polyester resin.

The binder resin may further include a vinyl resin. The inclusion of the vinyl resin in the binder resin may suppress aggregation of the toner during the process for producing the toner particles and during agitation of the toner in a developing unit, thus suppressing a point-like void that might otherwise arise from aggregation of the toner.

When the binder resin include a vinyl resin, the content of the vinyl resin relative to the total content of the toner particles is preferably 1 mass % or more and 30 mass % or less, more preferably 2 mass % or more and 20 mass % or less, still more preferably 2 mass % or more and 10 mass % or less. When the content of the vinyl resin is in the above range, as compared to when being lower than the above range, a point-like void that may arise from aggregation of the toner may be suppressed. When the content of the vinyl resin is in the above range, as compared to when being higher than the above range, the compatibility of the polyester resin with the vinyl resin may be high, and the transparency of the binder resin may improve, thus providing a fixed image with high color forming properties.

The content of the binder resin is, for example, preferably 40 mass % or more and 95 mass % or less, more preferably 50 mass % or more and 90 mass % or less, still more preferably 60 mass % or more and 85 mass % or less, relative to the total amount of the toner particles.

Colorant

Examples of the colorant include various pigments such as carbon black, chromium yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination of two or more.

Optionally, the colorant may be a surface-treated colorant or may be used in combination with a dispersant. The colorant may be a combination of different colorants.

The content of the colorant is, for example, preferably 1 mass % or more and 30 mass % or less, more preferably 3 mass % or more and 15 mass % or less, relative to the total amount of the toner particles.

Release Agent

Examples of the release agent include hydrocarbon waxes; natural waxes such as carnauba wax, rice wax, and Candelilla wax; synthetic or mineral/petroleum waxes such as montan wax; and ester waxes such as fatty acid esters and montanic acid esters, but are not limited thereto.

The melting temperature of the release agent is preferably 50° C. or more and 110° C. or less, more preferably 60° C. or more and 100° C. or less.

The melting temperature is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

The content of the release agent is, for example, preferably 1 mass % or more and 20 mass % or less, more preferably 5 mass % or more and 15 mass % or less, relative to the total amount of the toner particles.

Other Additives

Examples of other additives include well-known additives such as magnetic materials, charge control agents, and inorganic powders. These additives are contained as internal additives in the toner particles.

Properties of Toner Particles

The toner particles may be toner particles having a single-layer structure or toner particles having, what is called, a core-shell structure composed of a core (core particle) and a coating layer (shell layer) covering the core.

The toner particles having a core-shell structure may be composed of, for example, a core and a coating layer, the core containing a binder resin and other optional additives such as a coloring agent and a release agent, the coating layer containing a binder resin.

The volume-average particle size (D50v) of the toner particles is preferably 2 μm or more and 10 μm or less, more preferably 4 μm or more and 8 μm or less.

The various average particle sizes and various particle size distribution indices of the toner particles are measured using a COULTER MULTISIZER II (manufactured by Beckman Coulter, Inc.) and an ISOTON-II electrolyte solution (manufactured by Beckman Coulter, Inc.).

In the measurement, 0.5 mg or more and 50 mg or less of a test sample is added to 2 ml of a 5% aqueous solution of a surfactant (e.g., sodium alkylbenzenesulfonate) serving as a dispersant. The resulting solution is added to 100 ml or more and 150 ml or less of the electrolyte solution.

The electrolyte solution containing the suspended sample is dispersed with an ultrasonic disperser for one minute, and the particle size distribution of particles having a particle size of 2 μm or more and 60 μm or less is measured with the COULTER MULTISIZER II using an aperture having an aperture size of 100 μm. The number of sampled particles is 50,000.

The measured particle size distribution is divided into particle size ranges (channels). Cumulative volume and number distributions are plotted against the particle size ranges from smaller to larger sizes. The volume particle size D16v and the number particle size D16p are defined as the particle size at which the cumulative volume or number is 16%. The volume-average particle size D50v and the number-average particle size D50p are defined as the particle size at which the cumulative volume or number is 50%. The volume particle size D84v and the number particle size D84p are defined as the particle size at which the cumulative volume or number is 84%.

These values are used to calculate the volume particle size distribution index (GSDv) as $(D84v/D16v)^{1/2}$ and the number particle size distribution index (GSDp) as $(D84p/D16p)^{1/2}$.

The average circularity of the toner particles is preferably 0.94 or more and 1.00 or less, more preferably 0.95 or more and 0.98 or less.

The average circularity of the toner particles is determined by (peripheral length of equivalent circle)/(peripheral length) [(peripheral length of circle having same projected area as that of particle image)/(peripheral length of projected particle image)]. Specifically, the average circularity is measured by the following method.

First, target toner particles are collected by suction to form a flat flow, and strobe light is flashed to capture a still particle image. The particle image is analyzed with a flow particle image analyzer (FPIA-3000 manufactured by Sysmex Corporation). The number of particles sampled for determining the average circularity is 3,500.

When the toner contains an external additive, the toner (developer) to be measured is dispersed in water containing a surfactant and then sonicated to obtain toner particles from which the external additive has been removed.

Tg1 of the toner particles is 58° C. or more and 68° C. or less. To achieve both low-temperature fixability and suppression of a point-like void in an image, Tg1 is preferably 60° C. or more and 66° C. or less, more preferably 62° C. or more and 64° C. or less.

Tg1−Tg2 of the toner particles is 20° C. or more and 40° C. or less. To achieve both the color forming properties of a fixed image and suppression of print blocking, Tg1−Tg2 is preferably 25° C. or more and 38° C. or less, more preferably 30° C. or more and 36° C. or less.

Tg2 of the toner particles is preferably 15° C. or more and 55° C. or less, more preferably 25° C. or more and 50° C. or less, still more preferably 30° C. or more and 40° C. or less. When Tg2 of the toner particles is in the above range, as compared to when being higher than the above range, the heat resistance of a fixed image is high. Thus, image defects due to image transfer that may occur when a plurality of recording media each having a fixed image formed thereon are stacked on top of each other (i.e., print blocking) may be suppressed. When Tg2 of the toner particles is the above range, as compared to when being lower than the above range, the resistance to mechanical stress and thermal stress in a developing unit may improve to reduce the likelihood of aggregation of the toner, thus suppressing a point-like void in an image that might otherwise arise from aggregation of the toner.

The BET specific surface area of the toner particles is preferably 1.0 $m^2/g$ or more and 2.0 $m^2/g$ or less, more preferably 1.2 $m^2/g$ or more and 1.6 $m^2/g$ or less, still more preferably 1.3 $m^2/g$ or more and 1.5 $m^2/g$ or less.

When the BET specific surface area of the toner particles is in the above range, as compared to when being larger than the above range, a charge increase in a low-temperature and low-humidity environment, which may be caused by an excessively large surface area, may be suppressed. Thus, the difference between the electrical properties in a high-temperature and high-humidity environment and the electrical properties in a low-temperature and low-humidity environment is small, and a fixed image having high color forming properties may be provided in both the high-temperature and high-humidity environment and the low-temperature and low-humidity environment.

When the BET specific surface area of the toner particles is in the above range, as compared to when being smaller than the above range, the resistance to mechanical stress and thermal stress in a developing unit may be increased to reduce the likelihood of aggregation of the toner, thus suppressing a point-like void in an image that might otherwise arise from the formation of coarse powder of the toner.

The BET specific surface area of the toner particles is a value measured by the BET method under nitrogen purge using a BET specific surface area analyzer (SA3100 manufactured by Beckman Coulter, Inc.) as a measurement device. Specifically, the BET specific surface area ($m^2/g$) is a value obtained as follows: 1 g of a measurement sample is accurately weighed and placed in a sample tube, and the tube is then degassed and subjected to a multipoint automatic measurement.

If the toner particles to be measured have an external additive added to their surface, the measurement may be performed after removal of the external additive by performing sonication for 20 minutes together with a mixed solution of ion-exchange water and a surfactant, removal of the surfactant, and drying of the toner particles. The treatment for removing the external additive may be performed repeatedly until the external additive is removed.

The BET specific surface area of the toner particles can be controlled to be in the above range, for example, by performing the first cooling step, the holding step, and the second cooling step described below in the process for producing the toner particles and adjusting the pH of a toner particle dispersion in the holding step to 7.0 or more and 9.0 or less.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)$ n, $Al_2O_3{\cdot}2SiO_2$, $CaCO_3$, $MgCO_3$, $BaSO_4$, and $MgSO_4$.

The surface of inorganic particles used as an external additive may be subjected to hydrophobic treatment. The hydrophobic treatment may be performed, for example, by immersing the inorganic particles in a hydrophobic agent. Non-limiting examples of the hydrophobic agent include silane coupling agents, silicone oil, titanate coupling agents, and aluminum coupling agents. These hydrophobic agents may be used alone or in combination of two or more.

The amount of hydrophobic agent is typically, for example, 1 part by mass or more and 10 parts by mass or less relative to 100 parts by mass of the inorganic particles.

Other examples of the external additive include resin particles (particles of resins such as polystyrene, polymethyl methacrylate (PMMA), and melamine resins) and cleaning active agents (e.g., particles of higher fatty acid metal salts such as zinc stearate and fluoropolymers).

The amount of external additive added is, for example, preferably 0.01 mass % or more and 5 mass % or less, more preferably 0.01 mass % or more and 2.0 mass % or less, relative to the amount of the toner particles.

Method for Producing Toner

Next, a method for producing the toner according to the exemplary embodiment will be described.

The toner according to the exemplary embodiment is obtained by producing toner particles and then adding an external additive to the toner particles.

The toner particles may be produced by a dry process (e.g., kneading pulverization) or a wet process (e.g., aggregation and coalescence, suspension polymerization, or dissolution suspension). Not only these processes but any known process may be used to produce the toner particles.

Of these, aggregation and coalescence may be used to obtain the toner particles.

The toner particles included in the toner according to the exemplary embodiment may be toner particles subjected to a first cooling step of cooling a toner particle dispersion in which toner particles containing a binder resin are dispersed in a dispersion medium from a fusion temperature of T1° C. or more to a first cooling temperature of less than T2° C., a holding step of holding the toner particle dispersion that has been subjected to the first cooling step at a holding temperature of T3° C. or more and T4° C. or less for 0.5 hours or more and 3 hours or less with the pH of the toner particle dispersion being lowered, and a second cooling step of cooling the toner particle dispersion that has been subjected to the holding step to a second cooling temperature less than T5° C. and lower than the holding temperature.

T1° C.: Tg0° C.+29° C., where Tg0° C. is a glass transition temperature of the toner particles before being subjected to the first cooling step.

T2° C.: Tg0° C.+9° C.

T3° C.: Tg0° C.+4° C.

T4° C.: Tg0° C.+14° C.

T5° C.: Tg0° C.+9° C.

By performing the first cooling step, the holding step, and the second cooling step described above, toner particles whose Tg1−Tg2 is 20° C. or more and 40° C. or less may be readily obtained.

Tg0° C. means a lowest onset temperature in an endothermic change during a first temperature increase in a differential scanning calorimetry curve of the toner particles dispersed in the toner particle dispersion before being subjected to the first cooling step.

Tg0° C. may be, for example, 20° C. or more and 60° C. or less. To readily provide low-temperature fixability, Tg0° C. is preferably 25° C. or more and 57° C. or less, more preferably 30° C. or more and 55° C. or less.

Specifically, for example, when the toner particles are produced by aggregation and coalescence, the toner particles are produced by the following steps: a step (resin particle dispersion preparing step) of preparing a resin particle dispersion in which resin particles serving as a binder resin are dispersed; a step (an aggregated particle forming step) of aggregating the resin particles (and optionally other particles) in the resin particle dispersion (optionally in a dispersion mixture with any other particle dispersion) to form aggregated particles; a step (fusion and coalescence step) of heating the aggregated particle dispersion in which the aggregated particles are dispersed to a fusion temperature of 11° C. or more to fuse and coalesce the aggregated particles, thereby forming toner particles; a first cooling step of cooling a toner particle dispersion in which the formed toner particles are dispersed in a dispersion medium from a fusion temperature of 11° C. or more to a first cooling temperature of less than 12° C.; a holding step of holding the toner particle dispersion that has been subjected to the first cooling step at a holding temperature of 13° C. or more and 14° C. or less for 0.5 hours or more and 3 hours or less with the pH of the toner particle dispersion being lowered; and a second cooling step of cooling the toner particle dispersion that has been subjected to the holding step to a second cooling temperature less than 15° C. and lower than the holding temperature.

The steps will be described below in detail.

Although a method for producing toner particles containing a coloring agent and a release agent will be described below, the coloring agent and the release agent are optional. It should be understood that additives other than coloring agents and release agents may also be used.

Resin Particle Dispersion Preparing Step

First, a resin particle dispersion in which resin particles serving as a binder resin are dispersed as well as, for example, a coloring agent particle dispersion in which coloring agent particles are dispersed and a release agent particle dispersion in which release agent particles are dispersed are prepared.

The resin particle dispersion is prepared, for example, by dispersing resin particles in a dispersion medium with a surfactant.

Examples of the dispersion medium used to prepare the resin particle dispersion include aqueous media.

Examples of the aqueous media include water, such as distilled water and ion-exchanged water, and alcohols. These aqueous media may be used alone or in combination of two or more.

Examples of the surfactant include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. Of these, anionic surfactants and cationic surfactants are particularly preferred. Nonionic surfactants may be used in combination with anionic surfactants or cationic surfactants.

These surfactants may be used alone or in combination of two or more.

In preparing the resin particle dispersion, the resin particles may be dispersed in the dispersion medium, for example, by a commonly-used dispersion technique using a rotary shear homogenizer or a media mill such as a ball mill, a sand mill, or a Dyno-Mill. Depending on the type of resin particles, the resin particles may be dispersed in the resin particle dispersion, for example, by phase-inversion emulsification.

Phase-inversion emulsification is a process involving dissolving a resin of interest in a hydrophobic organic solvent capable of dissolving the resin, neutralizing the organic continuous phase (O-phase) by adding a base thereto, and then adding an aqueous medium (W-phase) to cause resin conversion (i.e., phase inversion) from water-in-oil (W/O) to oil-in-water (O/W) and form a discontinuous phase, thereby dispersing the resin in the form of particles in the aqueous medium.

The volume-average particle size of the resin particles dispersed in the resin particle dispersion is, for example, preferably 0.01 μm or more and 1 μm or less, more preferably 0.08 μm or more and 0.8 μm or less, still more preferably 0.1 μm or more and 0.6 μm or less.

The volume-average particle size of the resin particles is determined as follows. A particle size distribution is obtained using a laser diffraction particle size distribution analyzer (e.g., LA-700 manufactured by Horiba, Ltd.) and is divided into particle size classes (channels). A cumulative volume distribution is drawn from smaller particle sizes. The volume-average particle size D50v is measured as the particle size at which the cumulative volume is 50% of all particles. The volume-average particle sizes of particles in other dispersions are determined in the same manner.

The content of the resin particles in the resin particle dispersion is, for example, preferably 5 mass % or more and 50 mass % or less, more preferably 10 mass % or more and 40 mass % or less.

For example, the coloring agent particle dispersion and the release agent particle dispersion are prepared in the same manner as the resin particle dispersion. That is, the volume-average particle size, the dispersion medium, the dispersion technique, and the content of the particles in the resin particle dispersion also apply to coloring agent particles dispersed in the coloring agent particle dispersion and release agent particles dispersed in the release agent particle dispersion.

Aggregated Particle Forming Step

Next, the resin particle dispersion is mixed with the coloring agent particle dispersion and the release agent particle dispersion.

The resin particles, the coloring agent particles, and the release agent particles are then allowed to undergo hetero-aggregation in the mixed dispersion to form aggregated particles including the resin particles, the coloring agent particles, and the release agent particle. The aggregated particles have a particle size close to that of the desired toner particles.

Specifically, the aggregated particles are formed, for example, by adding an aggregating agent to the mixed dispersion, adjusting the mixed dispersion to an acidic pH (e.g., a pH of 2 to 5), optionally adding a dispersion stabilizer, and then heating the mixed dispersion to aggregate the particles dispersed therein. The mixed dispersion is heated to the glass transition temperature of the resin particles (e.g., the glass transition temperature of the resin particles−30° C. to the glass transition temperature of resin the particles−10° C.)

The aggregated particle forming step may be performed by, for example, adding an aggregating agent to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and then heating the mixed dispersion.

Examples of the aggregating agent include surfactants having polarity opposite to that of the surfactant used as a dispersant added to the mixed dispersion, inorganic metal salts, and metal complexes with a valence of two or more. In particular, the use of a metal complex as the aggregating agent may reduce the amount of surfactant used, which may improve the charging characteristics.

Additives that form a complex or a similar linkage together with metal ions of the aggregating agent may optionally be used. An example of such additives is a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of chelating agent added is, for example, preferably 0.01 parts by mass or more and 5.0 parts by mass or less, more preferably 0.1 parts by mass or more and less than 3.0 parts by mass, relative to 100 parts by mass of the resin particles.

Fusion and Coalescence Step

Next, the aggregated particle dispersion in which the aggregated particles are dispersed is heated to a fusion temperature of 11° C. or more to fuse and coalesce the aggregated particles, thereby forming toner particles.

The toner particles may also be produced through a step of, after preparing the aggregated particle dispersion in which the aggregated particles are dispersed, further mixing the aggregated particle dispersion with a resin particle dispersion in which resin particles are dispersed and aggregating the resin particles such that the resin particles adhere to the surface of the aggregated particles to form second aggregated particles; and a step of fusing and coalescing the second aggregated particles by heating the second aggregated particle dispersion in which the second aggregated particles are dispersed to form toner particles having a core-shell structure.

First Cooling Step

Next, a toner particle dispersion in which the toner particles formed in the fusion and coalescence step are dispersed in a dispersion medium is cooled from a fusion temperature of 11° C. or more to a first cooling temperature of less than 12° C.

The dispersion medium may be any liquid that disperses the toner particles, and the dispersion medium used for the aggregated particles in the aggregated particle dispersion may be used as it is.

The fusion temperature is (Tg0° C.+29° C.) or more. From the viewpoint of the speed at which the inside of the toner is fused, the fusion temperature is preferably (Tg0° C.+29° C.) or more and (Tg0° C.+40° C.) or less, more preferably (Tg0° C.+31° C.) or more and (Tg0° C.+38° C.) or less.

The first cooling temperature is less than (Tg0° C.+9° C.) To keep the surface of the toner smooth and prevent degradation of electrical properties, the first cooling temperature is preferably (Tg0° C.−34° C.) or more and less than (Tg0° C.+0° C.), more preferably (Tg0° C.−24° C.) or more and (Tg0° C.−5° C.) or less.

The difference between the fusion temperature and the first cooling temperature is more than 20° C. To keep the surface of the toner smooth and prevent degradation of electrical properties, the difference is preferably more than 20° C. and 50° C. or less, more preferably 30° C. or more and 40° C. or less.

A cooling rate A1 in the first cooling step is preferably 30° C./min or more and 130° C./min or less, more preferably 35° C./min or more and 110° C./min or less, still more preferably 40° C./min or more and 100° C./min or less. When the cooling rate A1 is in the above range, as compared to when being lower than the above range, aggregation of the toner may be suppressed to suppress a point-like void in an image that might otherwise arise from aggregation of the toner, and crystallization of the binder resin may be suppressed to provide a fixed image having high color forming properties. When the cooling rate A1 is in the above range, as compared to when being higher than the above range, the compatibility between the resins may be increased, thus improving low-temperature fixability.

The cooling rate A1 can be controlled to be in the above range, for example, by using a heat exchanger or adding cooling water to the toner dispersion.

The cooling rate A1 is preferably faster than a cooling rate A2 in the second cooling step described below, more preferably 1.5 to 6 times the cooling rate A2, still more preferably 2 to 3 times the cooling rate A2.

To suppress the formation of coarse powder of the toner and prevent degradation of the electrical properties of the toner, the pH of the toner particle dispersion in the first cooling step (hereinafter also referred to as "$pH^1$") is preferably 7.5 or more and 10.0 or less, more preferably 8.0 or more and 9.7 or less, still more preferably 8.3 or more and 9.5 or less.

Holding Step

Next, the toner particle dispersion that has been subjected to the first cooling step is held at a holding temperature of 13° C. or more and 14° C. or less for 0.5 hours or more and 3 hours or less with the pH of the toner particle dispersion being lowered.

The pH of the toner particle dispersion in the holding step (hereinafter also referred to as "$pH^2$") is lower than $pH^1$, preferably ($pH^1$−0.2) or less, more preferably ($pH^1$−2.1) or more and ($pH^1$−0.2) or less, still more preferably ($pH^1$−1.1) or more and ($pH^1$−0.2) or less.

The value of $pH^2$ is preferably 7.0 or more and 9.0 or less, more preferably 7.2 or more and 8.8 or less, still more preferably 7.4 or more and 8.7 or less. When the value of $pH^2$ is in the above range, as compared to when being lower than the above range, the formation of coarse powder may be suppressed, thus suppressing a point-like void in an image that might otherwise arise from coarse powder. When the value of $pH^2$ is in the above range, as compared to when being higher than the above range, toner particles having a low surface area may be readily obtained. Due to the appropriate BET specific surface area of the toner particles, a charge increase in a low-temperature and low-humidity environment may be suppressed, and a fixed image having high color forming properties may be provided in both a high-temperature and high-humidity environment and a low-temperature and low-humidity environment.

The holding temperature in the holding step is (Tg0° C.+4° C.) or more and (Tg0° C.+14° C.) or less. To help smoothen the surface of the toner, the holding temperature is preferably (Tg0° C.+6° C.) or more and (Tg0° C.+12° C.) or less, more preferably (Tg0° C.+7° C.) or more and (Tg0° C.+11° C.) or less.

The holding time in the holding step is 0.5 hours or more and 3 hours or less. From the viewpoint of improvement in smoothness of the toner surface and productivity, the holding time is preferably 0.75 hours or more and 2 hours or less, more preferably 1.0 hour or more and 1.5 hours or less.

Second Cooling Step

Next, the toner particle dispersion that has been subjected to the holding step is cooled to a second cooling temperature less than T5° C. and lower than the holding temperature.

The second cooling temperature is less than (Tg0° C.+9° C.). To suppress the formation of coarse powder of the toner, the second cooling temperature is preferably less than (Tg0° C.+4° C.), more preferably (Tg0° C.−30° C.) or more and less than (Tg0° C.−4° C.), still more preferably (Tg0° C.−20° C.) or more and (Tg0° C.−9° C.) or less.

From the viewpoint of improvement in smoothness of the toner surface and productivity, the difference between the holding temperature and the second cooling temperature is preferably 10° C. or more, preferably 10° C. or more and 25° C. or less, more preferably 15° C. or more and 30° C. or less.

The cooling rate A2 in the second cooling step may be, for example, 10° C./min or more and 50° C./min or less, and is preferably 15° C./rain or more and 40° C./min or less, more preferably 15° C./rain or more and 30° C./min or less.

After the second cooling step, a known washing step, a solid-liquid separation step, and a drying step are performed to obtain dry toner particles.

The washing step may be performed by sufficient displacement washing with ion-exchanged water in terms of charging characteristics. Although the solid-liquid separation step may be performed by any process, a process such as suction filtration or pressure filtration may be used in terms of productivity. Although the drying step may also be performed by any process, a process such as freeze drying, flash drying, fluidized bed drying, and vibrating fluidized bed drying may be used in terms of productivity.

The toner according to the exemplary embodiment is produced, for example, by adding an external additive to the dry toner particles obtained and mixing them together. The mixing may be performed, for example, with a V-blender, a Henschel mixer, or a Loedige mixer. Optionally, coarse toner particles may be removed using, for example, a vibrating screen or an air screen.

Electrostatic Image Developer

An electrostatic image developer according to an exemplary embodiment at least includes the toner according to the exemplary embodiment.

The electrostatic image developer according to the exemplary embodiment may be a one-component developer including the toner according to the exemplary embodiment alone or a two-component developer including a mixture of the toner and a carrier.

The carrier may be any known carrier. Examples of the carrier include coated carriers obtained by coating the surface of cores formed of magnetic powders with coating resins; magnetic-powder-dispersed carriers obtained by dispersing and blending magnetic powders in matrix resins; and resin-impregnated carriers obtained by impregnating porous magnetic powders with resins.

The magnetic-powder-dispersed carriers and the resin-impregnated carriers may also be carriers obtained by using the constituent particles of the carriers as cores and coating the cores with coating resins.

Examples of the magnetic powders include magnetic metals such as iron, nickel, and cobalt and magnetic oxides such as ferrite and magnetite.

Examples of the coating resins and the matrix resins include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins.

The coating resins and the matrix resins may contain conductive particles and other additives.

Examples of the conductive particles include particles of metals such as gold, silver, and copper, carbon black, titanium oxide, zinc oxide, tin oxide, barium sulfate, aluminum borate, and potassium titanate.

An example method for coating the surface of the core with the coating resin is coating with a solution for coating layer formation obtained by dissolving the coating resin and various optional additives in an appropriate solvent. Any solvent may be selected by taking into account factors such as the coating resin used and coating suitability.

Specific methods for coating the core with the coating resin include a dipping method in which the core is dipped in the solution for coating layer formation, a spraying method in which the surface of the core is sprayed with the solution for coating layer formation, a fluidized bed method in which the core suspended in an air stream is sprayed with the solution for coating layer formation, and a kneader-coater method in which the carrier core and the solution for coating layer formation are mixed in a kneader-coater and the solvent is removed.

The mixing ratio (mass ratio) of the toner to the carrier in the two-component developer is preferably 1:100 to 30:100, more preferably 3:100 to 20:100.

Image Forming Apparatus and Image Forming Method

An image forming apparatus according to an exemplary embodiment and an image forming method according to an exemplary embodiment will be described.

The image forming apparatus according to the exemplary embodiment includes an image carrier; a charging unit that charges a surface of the image carrier; an electrostatic image forming unit that forms an electrostatic image on the charged surface of the image carrier; a developing unit that contains an electrostatic image developer and develops, with the electrostatic image developer, the electrostatic image formed on the surface of the image carrier to form a toner image; a transfer unit that transfers the toner image formed on the surface of the image carrier onto a surface of a recording medium; and a fixing unit that fixes the toner image transferred onto the surface of the recording medium. As the electrostatic image developer, the electrostatic image developer according to the exemplary embodiment is used.

The image forming apparatus according to the exemplary embodiment executes an image forming method (the image forming method according to the exemplary embodiment) including a charging step of charging a surface of an image carrier, an electrostatic image forming step of forming an electrostatic image on the charged surface of the image carrier, a developing step of developing, with the electrostatic image developer according to the exemplary embodiment, the electrostatic image formed on the surface of the image carrier to form a toner image, a transferring step of transferring the toner image formed on the surface of the image carrier onto a surface of a recording medium, and a fixing step of fixing the toner image transferred onto the surface of the recording medium.

The image forming apparatus according to the exemplary embodiment may be a well-known image forming apparatus: for example, a direct-transfer apparatus that transfers a toner image formed on a surface of an image carrier directly to a recording medium; an intermediate-transfer apparatus that first transfers a toner image formed on a surface of an image carrier to a surface of an intermediate transfer body and then transfers the toner image transferred onto the surface of the intermediate transfer body to a surface of a recording medium; an apparatus including a cleaning unit that cleans a surface of an image carrier after the transfer of a toner image and before charging; or an apparatus including an erasing unit that erases charge on a surface of an image carrier by irradiation with erasing light after the transfer of a toner image and before charging.

In the case of an intermediate-transfer apparatus, the transfer unit includes, for example, an intermediate transfer body having a surface to which a toner image is transferred, a first transfer unit that transfers a toner image formed on a surface of an image carrier to the surface of the intermediate transfer body, and a second transfer unit that transfers the toner image transferred onto the surface of the intermediate transfer body to a surface of a recording medium.

In the image forming apparatus according to the exemplary embodiment, the section including the developing unit may be, for example, a cartridge structure (process cartridge) attachable to and detachable from the image forming apparatus. For example, a process cartridge including a developing unit containing the electrostatic image developer according to the exemplary embodiment is suitable for use as the process cartridge.

A non-limiting example of the image forming apparatus according to the exemplary embodiment will now be described. The parts illustrated in the drawings are described, and the description of other parts is omitted.

FIG. 1 illustrates a schematic configuration of the image forming apparatus according to the exemplary embodiment.

The image forming apparatus illustrated in FIG. 1 includes first to fourth electrophotographic image forming units 10Y, 10M, 10C, and 10K which respectively output yellow (Y), magenta (M), cyan (C), and black (K) images based on color-separated image data. These image forming units (hereinafter also referred to simply as "units") 10Y, 10M, 10C, and 10K are arranged side by side at predetermined intervals in the horizontal direction. The units 10Y, 10M, 10C, and 10K may be process cartridges attachable to and detachable from the image forming apparatus.

An intermediate transfer belt 20 serving as the intermediate transfer body extends above the units 10Y, 10M, 10C, and 10K in the figure so as to pass through the units. The intermediate transfer belt 20 is wound around a drive roller 22 and a support roller 24, which are spaced from each other in the horizontal direction in the figure, and is configured to run in the direction from the first unit 10Y toward the fourth unit 10K. The support roller 24 is in contact with the inner surface of the intermediate transfer belt 20. A spring or the like (not shown) applies a force to the support roller 24 in the direction away from the drive roller 22, so that tension is applied to the intermediate transfer belt 20 wound around the rollers 22 and 24. An intermediate transfer body cleaning device 30 is provided on the image carrier side of the intermediate transfer belt 20 so as to face the drive roller 22.

The units 10Y, 10M, 10C, and 10K respectively include developing devices (developing units) 4Y, 4M, 4C, and 4K to which toners of four colors, yellow, magenta, cyan, and black, are respectively supplied from toner cartridges 8Y, 8M, 8C, and 8K.

The first to fourth units 10Y, 10M, 10C, and 10K have the same configuration. Thus, the first unit 10Y, which is disposed upstream in the running direction of the intermediate transfer belt and forms a yellow image, will be described as a representative. The same components as those of the first unit 10Y are denoted by the same reference numerals followed by the letters M (magenta), C (cyan), and K (black) instead of the letter Y (yellow), and a description of the second to fourth units 10M, 10C, and 10K is omitted.

The first unit 10Y includes a photoreceptor 1Y. The photoreceptor 1Y functions as an image carrier and is surrounded by, in sequence, a charging roller 2Y (an example of the charging unit), an exposure device 3 (an example of the electrostatic image forming unit), a developing device 4Y (an example of the developing unit), a first transfer roller 5Y (an example of the first transfer unit), and a photoreceptor cleaning device 6Y (an example of the cleaning unit). The charging roller 2Y charges the surface of the photoreceptor 1Y to a predetermined potential. The exposure device 3 exposes the charged surface to a laser beam 3Y based on a color-separated image signal to form an electrostatic image. The developing device 4Y supplies a charged toner to the electrostatic image to develop the electrostatic image. The first transfer roller 5Y transfers the developed toner image onto the intermediate transfer belt 20. The photoreceptor cleaning device 6Y removes the toner remaining on the surface of the photoreceptor 1Y after the first transfer.

The first transfer roller 5Y is disposed inside the intermediate transfer belt 20 so as to face the photoreceptor 1Y. Furthermore, the first transfer rollers 5Y, 5M, 5C, and 5K are each connected to a bias power supply (not shown) that applies a first transfer bias. The value of transfer bias applied from each bias power supply to each first transfer roller is varied by control of a controller (not shown).

The operation of the first unit 10Y to form a yellow image will now be described.

Prior to the operation, the charging roller 2Y charges the surface of the photoreceptor 1Y to a potential of −600 V to −800 V.

The photoreceptor 1Y is formed of a conductive substrate (for example, having a volume resistivity of $1\times10^{-6}$ Ωcm or less at 20° C.) and a photosensitive layer stacked on the substrate. The photosensitive layer, which normally has high resistivity (resistivity of common resins), has the property of, upon irradiation with the laser beam 3Y, changing its resistivity in an area irradiated with the laser beam. The laser beam 3Y is emitted toward the charged surface of the photoreceptor 1Y via the exposure device 3 on the basis of yellow image data sent from the controller (not shown). The laser beam 3Y is applied to the photosensitive layer on the surface of the photoreceptor 1Y, as a result of which an electrostatic image with a yellow image pattern is formed on the surface of the photoreceptor 1Y.

The electrostatic image is an image formed on the surface of the photoreceptor 1Y by charging. Specifically, the electrostatic image is what is called a negative latent image formed in the following manner: in the area of the photosensitive layer irradiated with the laser beam 3Y, the resistivity drops, and the charge on the surface of the photoreceptor 1Y dissipates from the area, while the charge remains in the area not irradiated with the laser beam 3Y.

As the photoreceptor 1Y rotates, the electrostatic image formed on the photoreceptor 1Y is brought to a predetermined development position. At the development position, the electrostatic image on the photoreceptor 1Y is visualized (developed) as a toner image by the developing device 4Y.

The developing device 4Y contains, for example, an electrostatic image developer containing at least a yellow toner and a carrier. The yellow toner is frictionally charged as it is stirred inside the developing device 4Y, and thus has a charge with the same polarity (negative) as that of the charge on the photoreceptor 1Y and is held on a developer roller (an example of the developer carrier). As the surface of the photoreceptor 1Y passes through the developing device 4Y, the yellow toner is electrostatically attached to the neutralized latent image portion on the surface of the photoreceptor 1Y to develop the latent image. The photoreceptor 1Y on which the yellow toner image is formed continues to rotate at a predetermined speed to transport the toner image developed on the photoreceptor 1Y to a predetermined first transfer position.

After the yellow toner image on the photoreceptor 1Y is transported to the first transfer position, a first transfer bias is applied to the first transfer roller 5Y, and electrostatic force directed from the photoreceptor 1Y toward the first transfer roller 5Y acts on the toner image to transfer the toner image on the photoreceptor 1Y to the intermediate transfer belt 20. The transfer bias applied has the opposite polarity (positive) to the toner (negative). For example, the transfer bias for the first unit 10Y is controlled to +10 μA by the controller (not shown).

The toner remaining on the photoreceptor 1Y is removed and collected by the photoreceptor cleaning device 6Y.

The first transfer biases applied to the first transfer rollers 5M, 5C, and 5K of the second to fourth units 10M, 10C, and 10K are controlled in the same manner as in the first unit.

Thus, the intermediate transfer belt 20 to which the yellow toner image is transferred by the first unit 10Y is sequentially transported through the second to fourth units 10M, 10C, and 10K, and as a result, toner images of the respective colors are transferred in a superimposed manner.

The intermediate transfer belt 20, to which the toner images of the four colors are transferred in a superimposed manner through the first to fourth units, runs to a second transfer section including the intermediate transfer belt 20, the support roller 24 in contact with the inner surface of the intermediate transfer belt, and a second transfer roller 26 (an example of the second transfer unit) disposed on the image carrier side of the intermediate transfer belt 20. A recording paper P (an example of the recording medium) is fed into the nip between the second transfer roller 26 and the intermediate transfer belt 20 at a predetermined timing by a feed mechanism, and a second transfer bias is applied to the support roller 24. The transfer bias applied has the same polarity (negative) as the toner (negative), and electrostatic force directed from the intermediate transfer belt 20 toward the recording paper P acts on the toner image to transfer the toner image on the intermediate transfer belt 20 to the recording paper P. The second transfer bias is determined depending on the resistance detected by a resistance detector (not shown) that detects the resistance of the second transfer section, and thus the voltage is controlled.

The recording paper P is then sent to a pressure-contact part (nip part) between a pair of fixing rollers of a fixing device (an example of a fixing unit) 28, and the toner image is fixed to the recording paper P, thus forming a fixed image.

Examples of the recording paper P to which the toner image is transferred include plain paper for use in electrophotographic copiers, printers, and other devices. Examples of recording media other than the recording paper P include OHP sheets.

To further improve the surface smoothness of the fixed image, the surface of the recording paper P may also be smooth. For example, coated paper, i.e., plain paper coated with resin or the like and art paper for printing are suitable for use.

The recording paper P after completion of the fixing of the color image is conveyed to a discharge unit. Thus, the color image forming operation is complete.

Process Cartridge and Toner Cartridge

A process cartridge according to an exemplary embodiment will be described.

The process cartridge according to the exemplary embodiment includes a developing unit that contains the electrostatic image developer according to the exemplary embodiment and that develops, with the electrostatic image developer, an electrostatic image formed on a surface of an image carrier to form a toner image. The process cartridge is attachable to and detachable from an image forming apparatus.

The process cartridge according to the exemplary embodiment may have other configurations. For example, the process cartridge according to the exemplary embodiment may include a developing device and optionally at least one selected from other units such as an image carrier, a charging unit, an electrostatic image forming unit, and a transfer unit.

A non-limiting example of the process cartridge according to the exemplary embodiment will now be described. The parts illustrated in the drawings are described, and the description of other parts is omitted.

Figure 2:
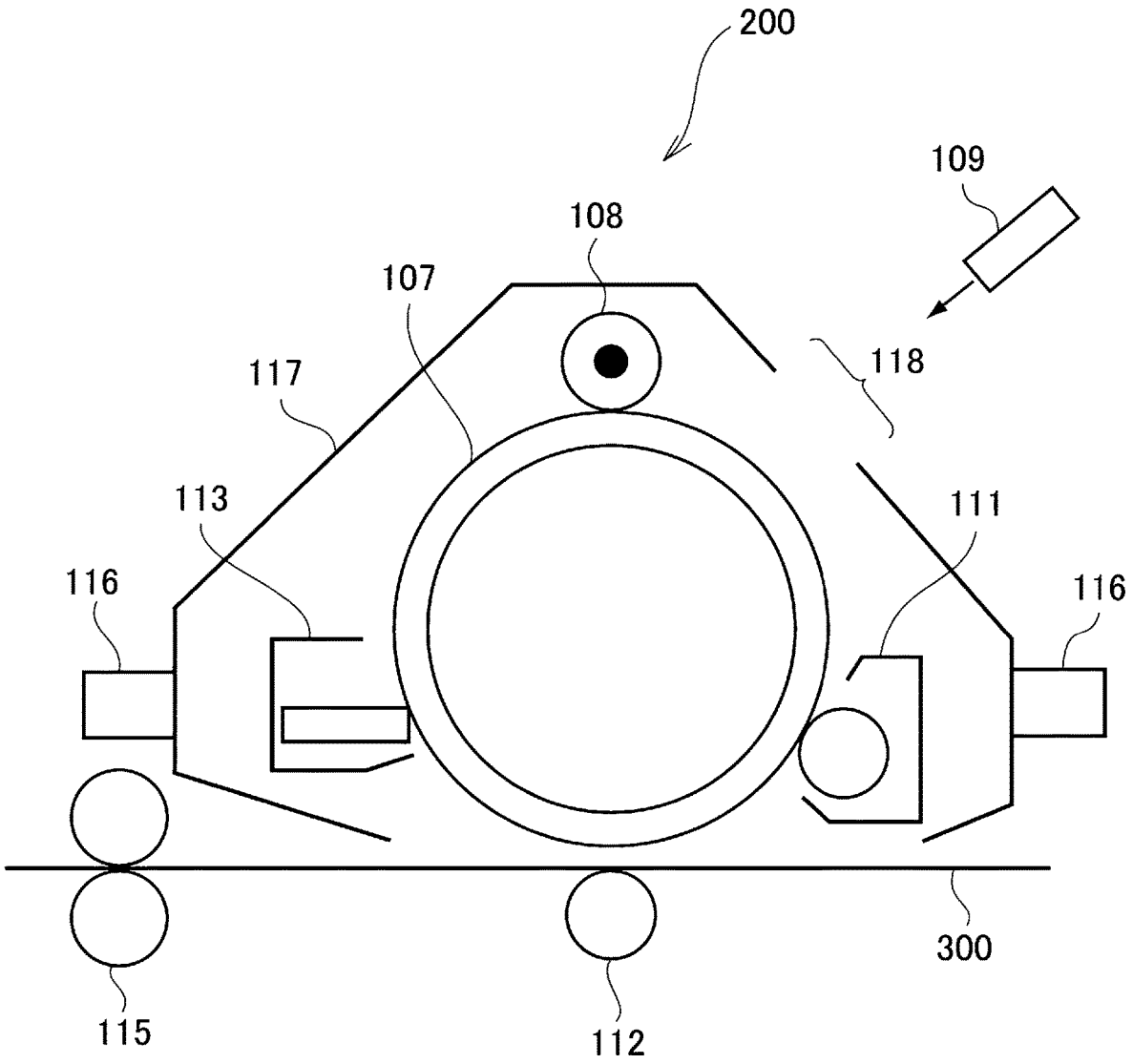
FIG. 2 illustrates a schematic configuration of a process cartridge according to an exemplary embodiment.

FIG. 2 illustrates a schematic configuration of the process cartridge according to the exemplary embodiment.

A process cartridge 200 illustrated in FIG. 2 includes, for example, a photoreceptor 107 (an example of the image carrier), a charging roller 108 (an example of the charging unit) disposed on the periphery of the photoreceptor 107, a developing device 111 (an example of the developing unit), and a photoreceptor cleaning device 113 (an example of the cleaning unit). These units are combined and held together into a cartridge with a housing 117 having mounting rails 116 and an opening 118 for exposure.

In FIG. 2, 109 represents an exposure device (an example of the electrostatic image forming unit), 112 represents a transfer device (an example of the transfer unit), 115 represents a fixing device (an example of the fixing unit), and 300 represents a recording paper (an example of the recording medium).

Next, a toner cartridge according to an exemplary embodiment will be described.

The toner cartridge according to the exemplary embodiment contains the toner according to the exemplary embodiment and is attachable to and detachable from an image forming apparatus. The toner cartridge contains replenishment toner to be supplied to a developing unit provided in the image forming apparatus.

The image forming apparatus illustrated in FIG. 1 is configured such that the toner cartridges 8Y, 8M, 8C, and 8K are attachable thereto and detachable therefrom. The developing devices 4Y, 4M, 4C, and 4K are connected to the toner cartridges corresponding to the developing devices (colors) through toner supply tubes (not shown). The toner cartridges are replaced when the amount of toner therein is decreased.

EXAMPLES

Examples will be described below, but it should be noted that these Examples are not intended to limit the present disclosure. In the following description, all parts and percentages are by mass unless otherwise specified.

Preparation of Particle Dispersion

Preparation of Amorphous Polyester Resin Particle Dispersion

Into a reaction container equipped with a stirrer, a thermometer, a condenser, and a nitrogen gas inlet tube, 80 molar parts of polyoxypropylene (2,2)-2,2-bis(4-hydroxyphenyl)propane, 10 molar parts of ethylene glycol, 10 molar parts of cyclohexanediol, 80 molar parts of terephthalic acid, 10 molar parts of isophthalic acid, and 10 molar parts of n-dodecenylsuccinic acid are put, and the reaction container is purged with dry nitrogen gas. Thereafter, titanium tetrabutoxide serving as a catalyst is put into the reaction container in an amount of 0.25 parts by mass relative to 100 parts by mass of the monomer components. Under a stream of nitrogen gas, stirring is performed at 170° C. for 3 hours to cause a reaction, after which the temperature is further increased to 210° C. over one hour, and the pressure in the reaction container is reduced to 3 kPa. Under reduced pressure, the reaction is allowed to proceed with stirring for 13 hours to obtain an amorphous polyester resin having a weight-average molecular weight of 20,000 and a glass transition temperature of 61° C.

Next, 200 parts by mass of the amorphous polyester resin, 100 parts by mass of methyl ethyl ketone, and 70 parts by mass of isopropyl alcohol are placed in a 3 L jacketed reaction vessel (BJ-30N manufactured by TOKYO RIKAKIKAI CO., LTD.) equipped with a condenser, a thermometer, a water dropper, and an anchor impeller. With the temperature being maintained at 70° C. by using a water-circulation-type constant temperature vessel, the resin is dissolved while mixing the components with stirring at 100 rpm. Thereafter, the number of stirring rotations is changed to 150 rpm, and the water-circulation-type constant temperature vessel is set to 66° C. After 10 parts by mass of 10 mass % aqueous ammonia (reagent) is put into the reaction vessel over 10 minutes, 600 parts by mass of ion-exchange water maintained at 66° C. is added dropwise into the reaction vessel at a rate of 5 parts by mass per minute to cause phase inversion, thereby obtaining an emulsified liquid.

Six hundred parts of the emulsified liquid and 525 parts by mass of ion-exchange water are placed in a 2 L recovery flask, and the flask is mounted to an evaporator (manufactured by TOKYO RIKAKIKAI CO., LTD.) equipped with a vacuum-control unit with a trap ball interposed therebetween. The recovery flask is heated in a hot-water bath at 60° C. while being rotated, and the pressure is reduced to 7 kPa to remove the solvents while taking care not to cause bumping. When the amount of recovered solvent reaches 825 parts by mass, the pressure is returned to normal pressure, and the recovery flask is cooled with water to obtain a dispersion in which resin particles having a volume-average particle size of 160 nm are dispersed. Ion-exchange water is added thereto to obtain an amorphous polyester resin particle dispersion having a solids concentration of 20 mass %.

Preparation of Crystalline Polyester Resin Particle Dispersion 1,10-Decanedicarboxylic acid: 260 parts by mass 1,6-Hexanediol: 167 parts by mass Dibutyl tin oxide (catalyst): 0.3 parts by mass The above materials are placed in a three-necked flask dried by heating. The three-necked flask is purged with nitrogen gas to create an inert atmosphere, and reflux is performed under mechanical stirring at 180° C. for 5 hours. The temperature is then gradually increased to 230° C. under reduced pressure, and stirring is performed for 2 hours. When becoming viscous, the mixture is cooled in air to stop the reaction. In this manner, a crystalline polyester resin having a weight-average molecular weight of 12,600 and a melting temperature of 73° C. is obtained.

Ninety parts of the crystalline polyester resin, 1.8 parts of an anionic surfactant (TAYCAPOWER manufactured by TAYCA CORPORATION), and 210 parts of ion-exchange water are mixed together, heated to 120° C., and dispersed using a homogenizer (ULTRA-TURRAX T50 manufactured by IKA), after which a dispersion treatment is performed for one hour using a pressure discharge GAULIN homogenizer to obtain a resin particle dispersion in which resin particles having a volume-average particle size of 160 nm are dispersed. Ion-exchange water is added to the resin particle dispersion to adjust the solids content to 20 mass %, thereby obtaining a crystalline polyester resin particle dispersion.

Preparation of Styrene Acrylic Resin Particle Dispersion

Styrene: 375 parts by mass
n-Butyl acrylate: 25 parts by mass
Acrylic acid: 2 parts by mass
Dodecanethiol: 24 parts by mass
Carbon tetrabromide: 4 parts by mass In a flask, a mixture obtained by mixing and dissolving the above materials is dispersed and emulsified in a surfactant solution of 6 parts by mass of a nonionic surfactant (NONIPOL 400 manufactured by Sanyo Chemical Industries, Ltd.) and 10 parts by mass of an anionic surfactant (TAYCAPOWER manufactured by TAYCA CORPORATION) in 550 parts by mass of ion-exchange water. Subsequently, an aqueous solution of 4 parts by mass of ammonium persulfate in 50 parts by mass of ion-exchange water is put into the flask over 20 minutes while stirring the contents of the flask. Subsequently, nitrogen purging is performed, and then while stirring the contents of the flask, the flask is heated in an oil bath until the temperature of the contents reaches 70° C. The temperature is held at 70° C. for 5 hours to continue the emulsion polymerization. In this manner, a resin particle dispersion in which resin particles having a volume-average particle size of 160 nm and a weight-average molecular weight 56,000 are dispersed is obtained. Ion-exchange water is added to the resin particle dispersion to adjust the solids content to 20 mass %, thereby obtaining a styrene acrylic resin particle dispersion.

Preparation of Release Agent Dispersion

Paraffin wax (FNP92 manufactured by Nippon Seiro Co., Ltd., endothermic peak onset: 81° C.): 45 parts by mass
Anionic surfactant (NEOGEN RK manufactured by DKS Co., Ltd.): 5 parts by mass
Ion-exchange water: 200 parts by mass The above materials are mixed together, heated to 95° C., and dispersed using a homogenizer (ULTRA-TURRAX T50 manufactured by manufactured by IKA). Thereafter, a dispersion treatment is performed using a MANTON-GAULIN high-pressure homogenizer (Gaulin Corporation) to prepare a release agent dispersion (solids concentration: 20 mass %) in which a release agent is dispersed. The volume-average particle size of release agent particles is 0.19 μm.

Preparation of Colorant Dispersion

Cyan pigment (Pigment Blue 15:3 (copper phthalocyanine) manufactured by Dainichiseika Color & Chemicals Mfg. Co., Ltd.): 98 parts by mass
Anionic surfactant (NEOGEN R manufactured by DKS Co., Ltd.): 2 parts by mass
Ion-exchange water: 400 parts by mass The above materials are mixed and dissolved together, and dispersed using a homogenizer (IKA ULTRA-TURRAX) for 10 minutes to obtain a colorant dispersion having a median particle size of 0.16 μm and a solids content of 20 mass %.

Preparation of Carrier

In a pressure kneader, 100 parts by mass of ferrite particles (manufactured by Powdertech Co., Ltd., average particle size: 50 μm), 1.5 parts by mass of polymethyl methacrylate resin (manufactured by Mitsubishi Chemical Corporation, weight-average molecular weight: 95,000, proportion of components having weight-average molecular weight of 10,000 or less: 5 mass %), and 500 parts by mass of toluene are placed and mixed with stirring at normal temperature (25° C.) for 15 minutes. The mixture is then heated to 70° C. while being mixed under reduced pressure to distill off toluene, and then cooled and classified using a 105 μm sieve to obtain a resin-coated ferrite carrier.

Preparation of Toner and Developer

Example 1

Preparation of Toner Particles (1)

Amorphous polyester resin particle dispersion: 100 parts by mass
Crystalline polyester resin particle dispersion: 20 parts by mass
Styrene acrylic resin particle dispersion: 7.3 parts by mass
Colorant particle dispersion: 10 parts by mass
Release agent particle dispersion: 9 parts by mass
Anionic surfactant (TAYCAPOWER BN2060 manufactured by TAYCA CORPORATION): 1 part by mass
Ion-exchange water: 200 parts by mass The above raw materials are placed in a 2 L cylindrical stainless steel container 1, and 3 parts by mass of a 0.3 M aqueous nitric acid solution is added thereto to adjust the pH to 3.0.

Subsequently, 50 parts by mass of a 10 mass % aqueous aluminum sulfate solution serving as an aggregating agent is added dropwise to the mixture while applying a shear force at 6,000 rpm using an ULTRATURRAX (manufactured by IKA Japan), and stirring is performed for 5 minutes.

The above raw material mixture is then heated to 45° C. with a heating mantle and held there for 30 minutes, after which a coating resin particle dispersion obtained by adjusting the pH of a mixture of 25 parts by mass of an amorphous polyester resin dispersion and 10 parts by mass of ion-exchange water to 3.0 in advance is added thereto for aggregated particle coating, and the resulting mixture is held for 10 minutes.

Thereafter, to stop the growth of coated aggregated particles (adhered particles), the pH ($pH^1$) of the raw material mixture is controlled to 9.0 by adding a 1 M aqueous sodium hydroxide solution. The temperature is then increased to a fusion temperature of 80° C. at a temperature increase rate of 1° C./min in order to fuse the aggregated particles. After 80° C. is reached, the average circularity is measured every 30 minutes until 0.966 while maintaining the temperature.

The glass transition temperature Tg0° C. of the toner particles dispersed in the resulting toner particle dispersion is shown in Table 1.

Thereafter, the toner dispersion is cooled to a first cooling temperature of 40° C. at a cooling rate A1 of 60° C./min using a heat exchanger (first cooling step). Furthermore, a 0.3 M aqueous nitric acid solution is added thereto for pH adjustment, and the pH ($pH^2$) is measured to be 7.5. Thereafter, the temperature is increased to a holding temperature of 57° C. and held there for one hour (holding step).

Thereafter, the toner dispersion is cooled to a second cooling temperature of 40° C. at a cooling rate A2 of 20° C./min using a heat exchanger (second cooling step).

Thereafter, filtration, redispersion in 3 liter of ion-exchange water, and solid-liquid separation by Nutsche suction filtration are repeated six times to obtain a wet cake. Vacuum drying is then performed for 12 hours to obtain toner base particles (1) having a volume-average particle size of 6.0 μm and an average circularity of 0.966. The values of Tg1, Tg1−Tg2, and BET specific surface area of the toner base particles (1) are shown in Table 2.

Preparation of Toner

Next, 1.5 parts by mass of hydrophobic silica (TS720 manufactured by Cabot Corporation) is added to 50 parts by mass of the toner base particles, and the resulting mixture is blended in a sample mill to obtain an externally added toner.

Preparation of Developer

The externally added toner and the resin-coated ferrite carrier are then mixed together to prepare a developer having a toner concentration of 7 mass %.

Examples 2 and 3

Toner base particles (2) and (3) are obtained in the same manner as in Example 1 except that the value of pH ($pH^2$) in the holding step are changed as shown in Table 1. The values of Tg1, Tg1−Tg2, and BET specific surface area of the toner base particles (2) and (3) are shown in Table 2.

Externally added toners and developers are prepared in the same manner as in Example 1 except that the toner base particles (2) and (3) are each used instead of the toner base particles (1).

Example 4

Toner base particles (4) are obtained in the same manner as in Example 1 except that the amount of styrene acrylic resin particle dispersion added is 1.4 parts by mass. The values of Tg1, Tg1−Tg2, and BET specific surface area of the toner base particles (4) are shown in Table 2.

An externally added toner and a developer are prepared in the same manner as in Example 1 except that the toner base particles (4) are used instead of the toner base particles (1).

Example 5

Toner base particles (5) are obtained in the same manner as in Example 1 except that the amount of styrene acrylic resin particle dispersion added is 59 parts by mass. The values of Tg1, Tg1−Tg2, and BET specific surface area of the toner base particles (5) are shown in Table 2.

An externally added toner and a developer are prepared in the same manner as in Example 1 except that the toner base particles (5) are used instead of the toner base particles (1).

Examples 6 to 9

Toner base particles (6) to (9) are obtained in the same manner as in Example 1 except that the holding temperature and the holding time are changed as shown in Table 1. The values of Tg1, Tg1−Tg2, and BET specific surface area of the toner base particles (6) to (9) are shown in Table 2.

Externally added toners and developers are prepared in the same manner as in Example 1 except that the toner base particles (6) to (9) are each used instead of the toner base particles (1).

Examples 10 and 11

Toner base particles (10) and (11) are obtained in the same manner as in Example 1 except that the cooling rate A1 is changed as shown in Table 1. The values of Tg1, Tg1−Tg2, and BET specific surface area of the toner base particles (10) and (11) are shown in Table 2.

Externally added toners and developers are prepared in the same manner as in Example 1 except that the toner base particles (10) and (11) are each used instead of the toner base particles (1).

Example 12

Toner base particles (12) are obtained in the same manner as in Example 1 except that the styrene acrylic resin particle dispersion is not used. The values of Tg1, Tg1−Tg2, and BET specific surface area of the toner base particles (12) are shown in Table 2.

An externally added toner and a developer are prepared in the same manner as in Example 1 except that the toner base particles (12) are used instead of the toner base particles (1).

Example 13

Toner base particles (13) are obtained in the same manner as in Example 1 except that the amount of styrene acrylic resin particle dispersion added is 75 parts by mass. The values of Tg1, Tg1−Tg2, and BET specific surface area of the toner base particles (13) are shown in Table 2.

An externally added toner and a developer are prepared in the same manner as in Example 1 except that the toner base particles (13) are used instead of the toner base particles (1).

Comparative Examples 1 and 2

Toner base particles (C1) and (C2) are obtained in the same manner as in Example 1 except that the holding temperature and the holding time are changed as shown in Table 1. The values of Tg1, Tg1−Tg2, and BET specific surface area of the toner base particles (C1) and (C2) are shown in Table 2.

Externally added toners and developers are prepared in the same manner as in Example 1 except that the toner base particles (C1) and (C2) are each used instead of the toner base particles (1).

Comparative Example 3

Toner base particles (C3) are obtained in the same manner as in Example 1 except that a toner is prepared without performing the holding step. The values of Tg1, Tg1−Tg2, and BET specific surface area of the toner base particles (C3) are shown in Table 2.

An externally added toner and a developer are prepared in the same manner as in Example 1 except that the toner base particles (C3) are used instead of the toner base particles (1).

Evaluation

Print Blocking

Test for Evaluation of Image Defects of Fixed Toner Image

As an evaluation sample maker, DocuCentre Color 450 manufactured by Fuji Xerox Co., Ltd. is used. Each of the developers obtained is loaded into a developing device. Using A4 sheets of OS coated 127 paper (basis weight: 127 gsm) manufactured by Fuji Xerox InterField Co., Ltd. as recording media, 100 images with a high area coverage (coverage: 100%, toner mass per unit area: 110 $g/m^2$) are continuously formed in an environment at 25° C. and 50% RH. The printed materials, that is, recording media each having an image formed thereon, are discharged all on the same output tray and left to stand for one hour in a stacked state.

Thereafter, the fixed image on the 51st printed material, which is most likely to undergo image defects in terms of the amount of latent heat and the pressure, is evaluated for image defects. Evaluation criteria are shown below, and the results are shown in Table 2.

Evaluation Criteria

G1: It is difficult to visually distinguish image defects.

G2: Image defects are worse than G1, but are slight and at an acceptable level.

G3: Image defects are worse than G2, but degradation of image quality is at an acceptable level.

G4: Image defects are serious, and degradation of image quality is at an unacceptable level.

Evaluation of Low-Temperature Fixability

Each of the electrostatic image developers obtained is loaded into a developing device of an electrophotographic copier (DocuCentre Color 450 manufactured by Fuji Xerox Co., Ltd.) from which a fixing device is detached, and an unfixed image is output. Specifically, a sheet of Vitality paper is used as a recording medium, and an unfixed image having an area coverage of 75% and measuring 25 mm×25 mm is formed on one side of the sheet. For fixation evaluation, a fixing device detached from a DocuPrint P450 manufactured by Fuji Xerox Co., Ltd. and adapted to enable changing of the fixing temperature is used.

Image fixation is performed at fixing temperatures increased from 110° C. to 160° C. in increments of 5° C., and the temperature (lowest fixing temperature) at which offset (image transfer to a fixing member due to insufficient melting of a toner image) at lower temperatures does not occur any more is classified as shown below. G1 and G2 are acceptable levels. The results are shown in Table 2.

G1: The lowest fixing temperature is 130° C. or lower.

G2: The lowest fixing temperature is higher than 130° C. and 150° C. or lower.

G3: The lowest fixing temperature is higher than 150° C.

Evaluation of Void

Each of the electrostatic image developers obtained is loaded into a developing device of a commercially available electrophotographic copier (DocuCentre Color 450 manufactured by Fuji Xerox Co., Ltd.). The test chart No. 5-2 of the Imaging Society of Japan is outputted on 10,000 sheets of stone color white (basis weight: 256 gsm) serving as a recording medium in a high-temperature and high-humidity environment (30° C., 85% RH), and image defects (the degree of voids) in a high-TMA part (i.e., region with a high toner mass per unit area) of the 10,001st image are evaluated. Evaluation criteria are shown below. G1 to G3 are acceptable levels. The results are shown in Table 2.

G1: No voids are found by visual observation or by loupe observation.

G2: No voids are found by visual observation, but less than three minor voids are found in one field of view by loupe observation.

G3: No voids are found by visual observation, but three or more and less than five minor voids are found in one field of view by loupe observation.

G4: Voids are found by visual observation, or five or more voids are found in one field of view by loupe observation. Unacceptable level.

Evaluation of Color Forming Properties

Each of the electrostatic image developers obtained is loaded into a developing device of a commercially available electrophotographic copier (DocuCentre Color 450 manufactured by Fuji Xerox Co., Ltd.) and left to stand in a high-temperature and high-humidity environment (30° C., 85% RH) for one day, after which an image with an area coverage of 1% is continuously formed on 10,000 sheets of A4 paper serving as recording media, and the image density of the 10,001st sheet is measured. The image density is determined using an X-Rite 939 (aperture size: 4 mm) manufactured by X-Rite Inc. The results are shown in Table 2.

Likewise, each of the electrostatic image developers obtained is loaded into a developing device of a commercially available electrophotographic copier (DocuCentre Color 450 manufactured by Fuji Xerox Co., Ltd.) and left to stand in a low-temperature and low-humidity environment (10° C., 15% RH) for one day, after which an image with an area coverage of 1% is continuously formed on 10,000 sheets of A4 paper serving as recording media, and the image density of the 10,001st sheet is measured. The difference between the image density in the high-temperature and high-humidity environment and the image density in the low-temperature and low-humidity environment (i.e., environmental dependency) is determined. Evaluation criteria are shown below. G1 to G3 are acceptable levels. The results are shown in Table 2.

G1: The image density (SAD) difference is 0.1 or less.

G2: The image density (SAD) difference is 0.2 or less.

G3: The image density (SAD) difference is 0.3 or less.

G4: The image density (SAD) difference is more than 0.3.

TABLE 1

| Base particles | Tg0 (° C.) | Holding temperature (° C.) | Holding time (h) | pH[2] | Cooling rate A1 (° C./min) | Vinyl resin vs toner particles (mass %) | Crystalline polyester resin vs binder resin (mass %) |
|---|---|---|---|---|---|---|---|
| (1) | 49 | 57 | 1 | 7.5 | 60 | 5 | 15.7 |
| (2) | 49 | 57 | 1 | 8.5 | 60 | 5 | 15.7 |
| (3) | 49 | 57 | 1 | 7.0 | 60 | 5 | 15.7 |
| (4) | 49 | 57 | 1 | 7.5 | 60 | 1 | 16.5 |
| (5) | 49 | 57 | 1 | 7.5 | 60 | 30 | 11.2 |
| (6) | 54 | 63 | 1 | 7.5 | 60 | 5 | 15.7 |
| (7) | 44 | 53 | 1 | 7.5 | 60 | 5 | 15.7 |
| (8) | 54 | 63 | 0.5 | 7.5 | 60 | 5 | 15.7 |
| (9) | 44 | 53 | 3 | 7.5 | 60 | 5 | 15.7 |
| (10) | 49 | 57 | 1 | 7.5 | 30 | 5 | 15.7 |
| (11) | 49 | 57 | 1 | 7.5 | 130 | 5 | 15.7 |
| (12) | 49 | 57 | 1 | 7.5 | 60 | 0 | 16.7 |
| (13) | 49 | 57 | 1 | 7.5 | 60 | 35 | 10.3 |
| (C1) | 55 | 65 | 0.4 | 7.5 | 60 | 5 | 15.7 |
| (C2) | 43 | 51 | 3.5 | 7.5 | 60 | 5 | 15.7 |
| (C3) | 49 | — | — | — | 60 | 5 | 15.7 |

TABLE 2

| | Toner particles | | | | Evaluations | | | | |
|---|---|---|---|---|---|---|---|---|---|
| | | | | | | | | Color forming properties | |
| | No. | Tg1 (° C.) | Tg2 (° C.) | Tg1 − Tg2 | BET specific surface area ($m^2/g$) | Print blocking | Low-temperature fixability | Void | High-temperature and high-humidity | Environmental dependency |
| Example 1 | (1) | 63 | 30 | 1.5 | G1 | G1 | G1 | 1.45 | G1 |
| Example 2 | (2) | 63 | 30 | 1.0 | G1 | G1 | G2 | 1.45 | G1 |
| Example 3 | (3) | 63 | 30 | 2.0 | G1 | G1 | G2 | 1.45 | G2 |
| Example 4 | (4) | 63 | 30 | 1.5 | G1 | G1 | G2 | 1.45 | G1 |
| Example 5 | (5) | 63 | 30 | 1.5 | G1 | G1 | G1 | 1.45 | G2 |
| Example 6 | (6) | 68 | 35 | 1.5 | G2 | G2 | G1 | 1.45 | G2 |
| Example 7 | (7) | 58 | 25 | 1.5 | G1 | G1 | G1 | 1.35 | G1 |
| Example 8 | (8) | 68 | 40 | 1.5 | G3 | G2 | G1 | 1.45 | G1 |
| Example 9 | (9) | 58 | 20 | 1.5 | G1 | G1 | G1 | 1.25 | G1 |
| Example 10 | (10) | 63 | 30 | 1.5 | G1 | G1 | G2 | 1.45 | G1 |
| Example 11 | (11) | 63 | 30 | 1.5 | G1 | G1 | G2 | 1.45 | G3 |
| Example 12 | (12) | 63 | 30 | 1.5 | G1 | G1 | G3 | 1.45 | G1 |
| Example 13 | (13) | 63 | 30 | 1.5 | G1 | G1 | G1 | 1.45 | G3 |
| Comparative Example 1 | (C1) | 69 | 41 | 1.5 | G4 | G3 | G1 | 1.45 | G1 |
| Comparative Example 2 | (C2) | 57 | 19 | 1.5 | G4 | G1 | G4 | 1.15 | G4 |
| Comparative Example 3 | (C3) | 63 | 15 | 2.2 | G1 | G1 | G4 | 1.10 | G4 |

The above results show that the toners of Examples, as compared to the toners of Comparative Examples, have low-temperature fixability and may also provide fixed images having high color forming properties.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising toner particles containing a binder resin, wherein in a differential scanning calorimetry curve of the toner particles in which Tg1 is a lowest onset temperature in an endothermic change during a first temperature increase, and Tg2 is a lowest onset temperature in an endothermic change during a second temperature increase that occurs after the first temperature increase, holding the temperature at 150° C. for 5 minutes, and then decreasing the temperature to 0° C. at a temperature decrease rate of 10° C./min:

Tg1 is 58° C. or more and 68° C. or less, and

Tg1−Tg2 is 20° C. or more and 40° C. or less.

2. The electrostatic image developing toner according to claim 1, wherein the toner particles have a BET specific surface area of 1.0 $m^2/g$ or more and 2.0 $m^2/g$ or less.

3. The electrostatic image developing toner according to claim 1, wherein the binder resin includes a polyester resin.

4. The electrostatic image developing toner according to claim 3, wherein the polyester resin includes a crystalline polyester resin.

5. The electrostatic image developing toner according to claim 4, wherein a content of the crystalline polyester resin is 5 mass % or more and 25 mass % or less relative to a total content of the binder resin.

6. The electrostatic image developing toner according to claim 3, wherein the binder resin further includes a vinyl resin.

7. The electrostatic image developing toner according to claim 6, wherein a content of the vinyl resin is 1 mass % or more and 30 mass % or less relative to a total content of the toner particles.

8. An electrostatic image developer comprising the electrostatic image developing toner according to claim 1.

9. A process cartridge attachable to and detachable from an image forming apparatus, the process cartridge comprising a developing unit that contains the electrostatic image developer according to claim 8 and develops, with the electrostatic image developer, an electrostatic image formed on a surface of an image carrier to form a toner image.

10. An image forming apparatus comprising:

an image carrier;

a charging unit that charges a surface of the image carrier;

an electrostatic image forming unit that forms an electrostatic image on the charged surface of the image carrier;

a developing unit that contains the electrostatic image developer according to claim 8 and develops, with the electrostatic image developer, the electrostatic image formed on the surface of the image carrier to form a toner image;

a transfer unit that transfers the toner image formed on the surface of the image carrier onto a surface of a recording medium; and a fixing unit that fixes the toner image transferred onto the surface of the recording medium.

11. A toner cartridge attachable to and detachable from an image forming apparatus, the toner cartridge comprising the electrostatic image developing toner according to claim 1.

12. A method for producing an electrostatic image developing toner, comprising:

cooling a toner particle dispersion in which toner particles containing a binder resin are dispersed in a dispersion medium from a fusion temperature of T1° C. or more to a first cooling temperature of less than T2° C.;

holding the toner particle dispersion that has been cooled to the first cooling temperature at a holding temperature of T3° C. or more and T4° C. or less for 0.5 hours or more and 3 hours or less with a pH of the toner particle dispersion being lowered; and cooling the toner particle dispersion that has been held to a second cooling temperature less than T5° C. and lower than the holding temperature, wherein T1° C. is Tg0° C.+29° C., where Tg0° C. is a glass transition temperature of the toner particles before being cooled to the first cooling temperature, T2° C. is Tg0° C.+9° C., T3° C. is Tg0° C.+4° C., T4° C. is Tg0° C.+14° C., and T5° C. is Tg0° C.+9° C.

13. The method for producing an electrostatic image developing toner according to claim 12, wherein in the holding, the pH of the toner particle dispersion that has been cooled to the first cooling temperature is adjusted to 7.0 or more and 9.0 or less.

14. The method for producing an electrostatic image developing toner according to claim 12, wherein a cooling rate A1 in the cooling to the first cooling temperature is 30° C./min or more and 130° C./min or less.

15. The method for producing an electrostatic image developing toner according to claim 12, wherein the binder resin includes a polyester resin.

16. The method for producing an electrostatic image developing toner according to claim 15, wherein the polyester resin includes a crystalline polyester resin.

17. The method for producing an electrostatic image developing toner according to claim 16, wherein a content of the crystalline polyester resin is 5 mass % or more and 25 mass % or less relative to a total content of the binder resin.

18. The method for producing an electrostatic image developing toner according to claim 15, wherein the binder resin further includes a vinyl resin.

19. The method for producing an electrostatic image developing toner according to claim 18, wherein a content of the vinyl resin is 1 mass % or more and 30 mass % or less relative to a total content of the toner particles.

20. An electrostatic image developing toner obtained by the method for producing an electrostatic image developing toner according to claim 12.

* * * * *